US008643477B2

(12) United States Patent
Belz et al.

(10) Patent No.: US 8,643,477 B2
(45) **Date of Patent: *Feb. 4, 2014**

(54) PROGRAMMING A UNIVERSAL REMOTE CONTROL VIA DIRECT INTERACTION

(75) Inventors: Steven M. Belz, Sunnyvale, TX (US); James Pratt, Round Rock, TX (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 757 days.

This patent is subject to a terminal disclaimer.

(21) Appl. No.: 12/476,180

(22) Filed: Jun. 1, 2009

(65) Prior Publication Data

US 2010/0302058 A1 Dec. 2, 2010

(51) Int. Cl.
*G08B 21/00* (2006.01)

(52) U.S. Cl.
USPC ..... 340/12.24; 340/12.22; 340/12.26; 340/4.11; 341/176; 348/734

(58) Field of Classification Search
USPC ..... 340/426.13, 426.14, 4.11, 12.22–12.26; 341/176; 348/734
See application file for complete search history.

(56) References Cited

U.S. PATENT DOCUMENTS 5,204,768 A * 4/1993 Tsakiris et al. ..... 398/107
6,650,248 B1 11/2003 O'Donnell et al.
7,046,185 B2 5/2006 Griesau et al.
7,106,209 B2 9/2006 Mui
7,224,903 B2 5/2007 Colmenarez et al.
7,671,758 B1 3/2010 Seidel et al.
7,949,305 B2 5/2011 Sullivan et al.
2003/0189509 A1* 10/2003 Hayes et al. ..... 341/176
2006/0152401 A1* 7/2006 Spilo ..... 341/176
2007/0268360 A1* 11/2007 Ahlgren ..... 348/14.01
2008/0174468 A1 7/2008 Drimusz
2008/0261514 A1 10/2008 Pratt et al.
2008/0297372 A1* 12/2008 Wouters ..... 340/825.69
2009/0021651 A1 1/2009 Pratt et al.
2009/0031375 A1 1/2009 Sullivan et al.
2009/0067591 A1 3/2009 Belz et al.
2009/0070696 A1 3/2009 Belz et al.
2009/0119181 A1 5/2009 Pratt et al.
2009/0125971 A1 5/2009 Belz et al.
2009/0157473 A1 6/2009 Belz et al.
2009/0158373 A1 6/2009 Belz et al.
2009/0180377 A1 7/2009 Sullivan et al.
2009/0187955 A1 7/2009 Sullivan et al.
2009/0231178 A1* 9/2009 Letourneur et al. ..... 341/176
2009/0245494 A1 10/2009 Sullivan et al.
2009/0288115 A1 11/2009 Belz et al.
2009/0312059 A1 12/2009 Pratt et al.
2009/0319607 A1 12/2009 Belz et al.
2010/0015999 A1 1/2010 Belz et al.
2010/0039214 A1 2/2010 Pratt et al.

(Continued)

*Primary Examiner* — Mohammad Ghayour
*Assistant Examiner* — Mark Rushing
(74) *Attorney, Agent, or Firm* — Jackson Walker L.L.P.

(57) ABSTRACT

A method and system for programming a universal remote control (URC) to operate with a remote-controlled device is disclosed. A user may be instructed to operate a control element of an original remote control (ORC) of the remote-controlled device. The control element of the ORC may be operated with consumer-premises equipment of the MCDN, which receives a code associated with the control element. The code may be used to identify the remote-controlled device and obtain corresponding programming codes. The URC may be configured to use at least one of the programming codes to remotely control the remote-controlled device.

22 Claims, 7 Drawing Sheets

(56) References Cited

U.S. PATENT DOCUMENTS

| | | | |
|---|---|---|---|
| 2010/0039282 | A1 | 2/2010 | Hostage et al. |
| 2010/0039392 | A1 | 2/2010 | Pratt et al. |
| 2010/0039393 | A1 | 2/2010 | Pratt et al. |
| 2010/0042827 | A1 | 2/2010 | Pratt et al. |
| 2010/0050270 | A1 | 2/2010 | Pratt et al. |
| 2010/0069012 | A1 | 3/2010 | Sullivan et al. |
| 2010/0082712 | A1 | 4/2010 | Pratt et al. |
| 2010/0088149 | A1 | 4/2010 | Sullivan et al. |
| 2010/0104024 | A1 | 4/2010 | Sullivan et al. |
| 2010/0113160 | A1 | 5/2010 | Belz et al. |
| 2010/0115592 | A1 | 5/2010 | Belz et al. |
| 2010/0115607 | A1 | 5/2010 | Pratt et al. |
| 2010/0118748 | A1 | 5/2010 | Pratt et al. |
| 2010/0119051 | A1 | 5/2010 | Belz et al. |
| 2010/0121744 | A1 | 5/2010 | Belz et al. |
| 2010/0122306 | A1 | 5/2010 | Pratt et al. |
| 2010/0124905 | A1 | 5/2010 | Pratt et al. |
| 2010/0134338 | A1 | 6/2010 | Belz et al. |
| 2010/0138499 | A1 | 6/2010 | Belz et al. |
| 2010/0138876 | A1 | 6/2010 | Sullivan et al. |
| 2010/0144368 | A1 | 6/2010 | Sullivan et al. |
| 2010/0149982 | A1 | 6/2010 | Pratt et al. |
| 2010/0150327 | A1 | 6/2010 | Belz et al. |
| 2010/0153764 | A1 | 6/2010 | Pratt et al. |
| 2010/0153995 | A1 | 6/2010 | Belz et al. |
| 2010/0158533 | A1 | 6/2010 | Belz et al. |
| 2010/0161801 | A1 | 6/2010 | Belz et al. |
| 2010/0162331 | A1 | 6/2010 | Belz et al. |
| 2010/0174572 | A1 | 7/2010 | Joseph et al. |
| 2010/0235872 | A1 | 9/2010 | Sullivan et al. |
| 2010/0275237 | A1 | 10/2010 | Pratt et al. |
| 2010/0289685 | A1 | 11/2010 | Pratt et al. |
| 2010/0289954 | A1 | 11/2010 | Sullivan et al. |
| 2010/0302057 | A1 | 12/2010 | Pratt et al. |
| 2011/0003587 | A1 | 1/2011 | Belz et al. |
| 2011/0010745 | A1 | 1/2011 | Belz et al. |
| 2011/0012710 | A1 | 1/2011 | Sullivan et al. |
| 2011/0029887 | A1 | 2/2011 | Pearson et al. |
| 2011/0037574 | A1 | 2/2011 | Pratt et al. |
| 2011/0037611 | A1 | 2/2011 | Van Vleck et al. |
| 2011/0037637 | A1 | 2/2011 | Van Vleck et al. |
| 2011/0090085 | A1 | 4/2011 | Belz et al. |
| 2011/0093876 | A1 | 4/2011 | Belz et al. |
| 2011/0093908 | A1 | 4/2011 | Van Vleck et al. |
| 2011/0095873 | A1 | 4/2011 | Pratt et al. |
| 2011/0109490 | A1 | 5/2011 | Belz et al. |
| 2011/0113459 | A1 | 5/2011 | Crowe et al. |
| 2011/0114716 | A1 | 5/2011 | Pratt |
| 2011/0115664 | A1 | 5/2011 | Belz et al. |
| 2011/0131605 | A1 | 6/2011 | Pratt et al. |

* cited by examiner

PROGRAMMING A UNIVERSAL REMOTE CONTROL VIA DIRECT INTERACTION

BACKGROUND

1. Field of the Disclosure

The present disclosure relates to remote control devices and, more particularly, to programming universal remote control devices.

2. Description of the Related Art

Remote control devices provide convenient operation of equipment from a distance. Many consumer electronic devices are equipped with remote control features. Universal remote control devices, which may be configured to control different pieces of equipment, are often difficult to reconfigure and reprogram.

DESCRIPTION OF THE EXEMPLARY EMBODIMENTS

Figure 1:
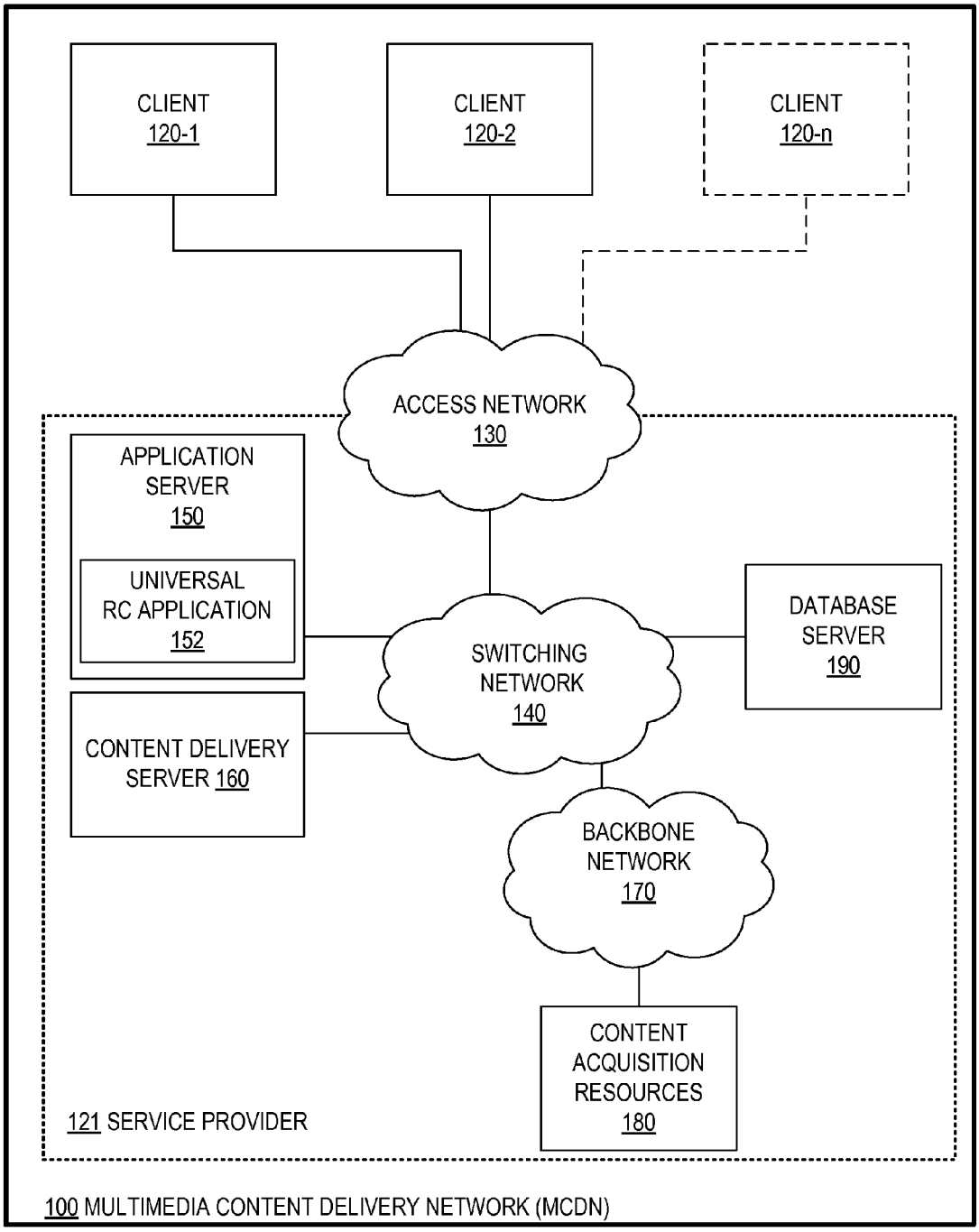
FIG. 1 is a block diagram of selected elements of an embodiment of a multimedia content distribution network.

In one aspect, a disclosed method for configuring a universal remote control (URC) over a multimedia content distribution network (MCDN) includes sending an instruction to prompt a user to operate a first control element of an original remote control (ORC) corresponding to a remote-controlled device. After the user operates the first control element, the method includes receiving a first code from the ORC, identifying the remote-controlled device based on the first code. In the method, programming codes for the identified remote-controlled device may then be retrieved. A universal remote control (URC) may be configured by the method to operate the remote-controlled device by programming the URC to use at least one of the programming codes. The URC may be programmed using a wireless communication link.

In specific embodiments, the method may include sending the first code to an MCDN server, and receiving, from the MCDN server, information indicating identified remote-controlled devices that are responsive to the first code. The method operation of retrieving programming codes for the identified remote-controlled device may further include retrieving programming codes from the MCDN server. The remote-controlled device may be uniquely identified using the received information.

In certain instances, the received information indicates more than one identified remote-control device. Then, the method may further include sending an instruction to prompt the user to operate a second control element of the ORC. After the user operates the second control element, the method may include receiving a second code from the ORC. The method may still further include sending the second code to the MCDN server, and receiving, from the MCDN server, information indicating identified remote-controlled devices that are responsive to both the first code and the second code.

In particular embodiments, the method also includes sending an identity of the remote-controlled device to the user, and receiving a confirmation from the user acknowledging the identity. Prior to sending the instruction to the user, an indication from the user describing a device type corresponding to the remote-controlled device may be received in the method. The method may still further include displaying a confirmation indicating that the URC has been successfully configured with at least one of the programming codes. Sending the instruction to the user may include sending an instruction to operate the ORC with consumer-premises equipment (CPE) associated with the MCDN.

In some embodiments, the CPE may be communicatively coupled to the remote-controlled device, while the method further includes receiving, from the URC, a command to control the remote-controlled device, and instructing the remote-controlled device to execute the command. The command may be associated with at least one of the programming codes.

In another aspect, a disclosed method for identifying a remote-controlled device over an MCDN may include receiving, from CPE of the MCDN, at least one code describing output generated by an ORC associated with a remote-controlled device. In the method, information indicating remote-controlled devices that are responsive to the at least one code may be obtained and sent to the CPE. The method may include receiving a CPE request for programming codes, the request specifying an identity of the remote-controlled device, and in response to the CPE request, sending programming codes for the identified remote-controlled device to the CPE. The method may still further include receiving a CPE request for at least one ORC control element, the request specifying a device type of the remote-controlled device, and in response to the CPE request, sending, to the CPE, information specifying at least one ORC control element.

In a further aspect, a disclosed CPE for use within a client configuration of an MCDN includes a processor, a local transceiver, and memory media accessible to the processor, including instructions executable by the processor. The processor executable instructions may be executable to prompt a user to operate a first control element of an ORC corresponding to a remote-controlled device, and after the user operates the first control element, receive a first code from the ORC at the local transceiver. In response to sending a request including the first code to an MCDN server, the processor executable instructions may further be executable to retrieve programming codes for the remote-controlled device, and program a URC to use at least one of the programming codes.

In one embodiment, the CPE may further include processor executable instructions to initiate programming of the URC in response to user input, and receive an indication from the user specifying a device type corresponding to the remote-controlled device. In response to sending the device type to the MCDN server, the processor executable instructions may be executable to obtain information from the MCDN server specifying at least one ORC control element, including the first control element.

In given embodiments, the CPE may further include processor executable instructions to prompt the user to operate a second control element of the ORC. After the user operates the second control element, the processor executable instructions may also be executable to receive a second code from the ORC at the local transceiver. In response to sending a request including the first code and the second code to an MCDN server, the processor executable instructions may further be executable to retrieve programming codes for the remote-controlled device. The processor executable instructions to prompt the user to operate the second control element may be performed in response to receiving an indication of more than one remote-controlled device that corresponds to the first code. The processor executable instructions may yet further be executable to receive, at the local transceiver from the URC, a command to control the remote-controlled device, and instruct the remote-controlled device to execute the command. The command may be associated with at least one of the programming codes. The processor executable instructions to prompt the user may include instructions to prompt the user to operate the ORC with the local transceiver.

In yet another aspect, a disclosed computer-readable memory media includes executable instructions for configuring a URC over an MCDN. The instructions may be executable to initiate programming of the URC in response to user input, receive an indication from the user specifying a device attribute corresponding to the remote-controlled device, and send the device attribute to an MCDN server. In response to said sending, the instructions may be executable to obtain information from the MCDN server specifying at least one control element of an ORC of the remote-controlled device, including a first control element, and prompt the user to operate the first control element by using the ORC with CPE of the MCDN. In response to the user operating the first control element, the instructions may also be executable to receive a first code from the ORC, identify the remote-controlled device using the first code, and retrieve programming codes for the identified remote-controlled device from the MCDN server.

In particular embodiments, the instructions are executable to configure the URC to operate the remote-controlled device by programming the URC to use at least one of the programming codes. The instructions may further be executable to receive, from the URC, a command to control the remote-controlled device, and instruct the remote-controlled device to execute the command. The command may be associated with at least one of the programming codes.

In certain embodiments, the instructions to identify the remote-controlled device using the first code may further include instructions executable to send a request to the MCDN server to identify the remote-controlled device, the request including the first code. In response to sending the request, the instructions may also be executable to receive an identity of the remote-controlled device.

In some embodiments, the instructions to identify the remote-controlled device using the first code may further include instructions executable to prompt the user to operate a second control element by using the ORC with CPE of the MCDN. In response to the user operating the second control element, the instructions may further be executable to receive a second code from the ORC, and send a request to the MCDN server to identify the remote-controlled device, the request including the first code and the second code. In response to sending the request, the instructions may still further be executable to receive an identity of the remote-controlled device.

In the following description, details are set forth by way of example to facilitate discussion of the disclosed subject matter. It should be apparent to a person of ordinary skill in the field, however, that the disclosed embodiments are exemplary and not exhaustive of all possible embodiments.

In the following description, details are set forth by way of example to facilitate discussion of the disclosed subject matter. It should be apparent to a person of ordinary skill in the field, however, that the disclosed embodiments are exemplary and not exhaustive of all possible embodiments. Throughout this disclosure, a hyphenated form of a reference numeral refers to a specific instance of an element and the un-hyphenated form of the reference numeral refers to the element generically or collectively. Thus, for example, widget 12-1 refers to an instance of a widget class, which may be referred to collectively as widgets 12 and any one of which may be referred to generically as a widget 12.

Turning now to the drawings, FIG. 1 is a block diagram illustrating selected elements of an embodiment of MCDN 100. Although multimedia content is not limited to TV, video on demand (VOD), or pay-per-view (PPV) programs, the depicted embodiments of MCDN 100 and its capabilities are primarily described herein with reference to these types of multimedia content, which are interchangeably referred to herein as "multimedia content", "multimedia content programs", "multimedia programs" or, simply, "programs."

The elements of MCDN 100 illustrated in FIG. 1 depict network embodiments with functionality for delivering multimedia content to a set of one or more subscribers. It is noted that different embodiments of MCDN 100 may include additional elements or systems (not shown in FIG. 1 for clarity) as desired for additional functionality, such as data processing systems for billing, content management, customer support, operational support, or other business applications.

As depicted in FIG. 1, MCDN 100 includes one or more clients 120 and a service provider 121. Each client 120 may represent a different subscriber of MCDN 100. In FIG. 1, a plurality of n clients 120 is depicted as client 120-1, client 120-2 to client **120-*n*, where n may be a large number. Service provider 121 as depicted in FIG. 1 encompasses resources to acquire, process, and deliver programs to clients 120 via access network 130. Such elements in FIG. 1 of service provider 121 include content acquisition resources 180 connected to switching network 140 via backbone network 170, as well as application server 150, database server 190, and content delivery server 160, also shown connected to switching network 140**.

Access network 130 demarcates clients 120 and service provider 121, and provides at least one connection path between clients 120 and service provider 121. In some embodiments, access network 130 is an Internet protocol (IP) compliant network. In some embodiments, access network 130 is, at least in part, a coaxial cable network. It is noted that in some embodiments of MCDN 100, access network 130 is owned and/or operated by service provider 121. In other embodiments, a third party may own and/or operate at least a portion of access network 130.

In IP-compliant embodiments of access network 130, access network 130 may include a physical layer of unshielded twist pair cables, fiber optic cables, or a combination thereof MCDN 100 may include digital subscribe line (DSL) compliant twisted pair connections between clients 120 and a node (not depicted) in access network 130 while fiber, cable or another broadband medium connects service provider resources to the node. In other embodiments, the broadband cable may extend all the way to clients 120.

As depicted in FIG. 1, switching network 140 provides connectivity for service provider 121, and may be housed in a central office or other facility of service provider 121. Switching network 140 may provide firewall and routing functions to demarcate access network 130 from the resources of service provider 121. In embodiments that employ DSL compliant connections, switching network 140 may include elements of a DSL Access Multiplexer (DSLAM) that multiplexes many subscriber DSLs to backbone network 170.

In FIG. 1, backbone network 170 represents a private network including, as an example, a fiber based network to accommodate high data transfer rates. Content acquisition resources 180 as depicted in FIG. 1 encompass the acquisition of various types of content including broadcast content, other "live" content including national content feeds, and VOD content.

Thus, the content provided by service provider 121 encompasses multimedia content that is scheduled in advance for viewing by clients 120 via access network 130. Such multimedia content, also referred to herein as "scheduled programming," may be selected using an electronic programming guide (EPG), such as EPG 316 described below with respect to FIG. 3. Accordingly, a user of MCDN 100 may be able to browse scheduled programming well in advance of the broadcast date and time. Some scheduled programs may be "regularly" scheduled programs, which recur at regular intervals or at the same periodic date and time (i.e., daily, weekly, monthly, etc.). Programs which are broadcast at short notice or interrupt scheduled programs are referred to herein as "unscheduled programming."

Acquired content is provided to content delivery server 160 via backbone network 170 and switching network 140. Content may be delivered from content delivery server 160 to clients 120 via switching network 140 and access network 130. Content may be compressed, encrypted, modulated, demodulated, and otherwise encoded or processed at content acquisition resources 180, content delivery server 160, or both. Although FIG. 1 depicts a single element encompassing acquisition of all content, different types of content may be acquired via different types of acquisition resources. Similarly, although FIG. 1 depicts a single content delivery server 160, different types of content may be delivered by different servers. Moreover, embodiments of MCDN 100 may include content acquisition resources in regional offices that are connected to switching network 140.

Although service provider 121 is depicted in FIG. 1 as having switching network 140 to which content acquisition resources 180, content delivery server 160, and application server 150 are connected, other embodiments may employ different switching networks for each of these functional components and may include additional functional components (not depicted in FIG. 1) including, for example, operational subsystem support (OSS) resources.

FIG. 1 also illustrates application server 150 connected to switching network 140. As suggested by its name, application server 150 may host or otherwise implement one or more applications for MCDN 100. Application server 150 may be any data processing system with associated software that provides applications for clients or users. Application server 150 may provide services including multimedia content services, e.g., EPGs, digital video recording (DVR) services, VOD programs, PPV programs, Internet protocol television (IPTV) portals, digital rights management (DRM) servers, navigation/middleware servers, conditional access systems (CAS), and remote diagnostics, as examples.

Applications provided by application server 150 may be downloaded and hosted on other network resources including, for example, content delivery server 160, switching network 140, and/or on clients 120. Application server 150 is configured with a processor and storage media (not shown in FIG. 1) and is enabled to execute processor instructions, such as those included within a software application. As depicted in FIG. 1, application server 150 may be configured to include URC application 152, which, as will be described in detail below, may be configured to cause client 120 of MCDN 100 to reprogram a URC device.

Further depicted in FIG. 1 is database server 190, which provides hardware and software resources for data warehousing. Database server 190 may communicate with other elements of the resources of service provider 121, such as application server 150 or content delivery server 160, in order to store and provide access to large volumes of data, information, or multimedia content. In some embodiments, database server 190 includes a data warehousing application, accessible via switching network 140, that can be used to record and access structured data, such as program or channel metadata for clients 120. Database server 190 may also store device information, such as identifiers for client 120, model identifiers for remote control devices, and programming codes for URCs.

Figure 2:
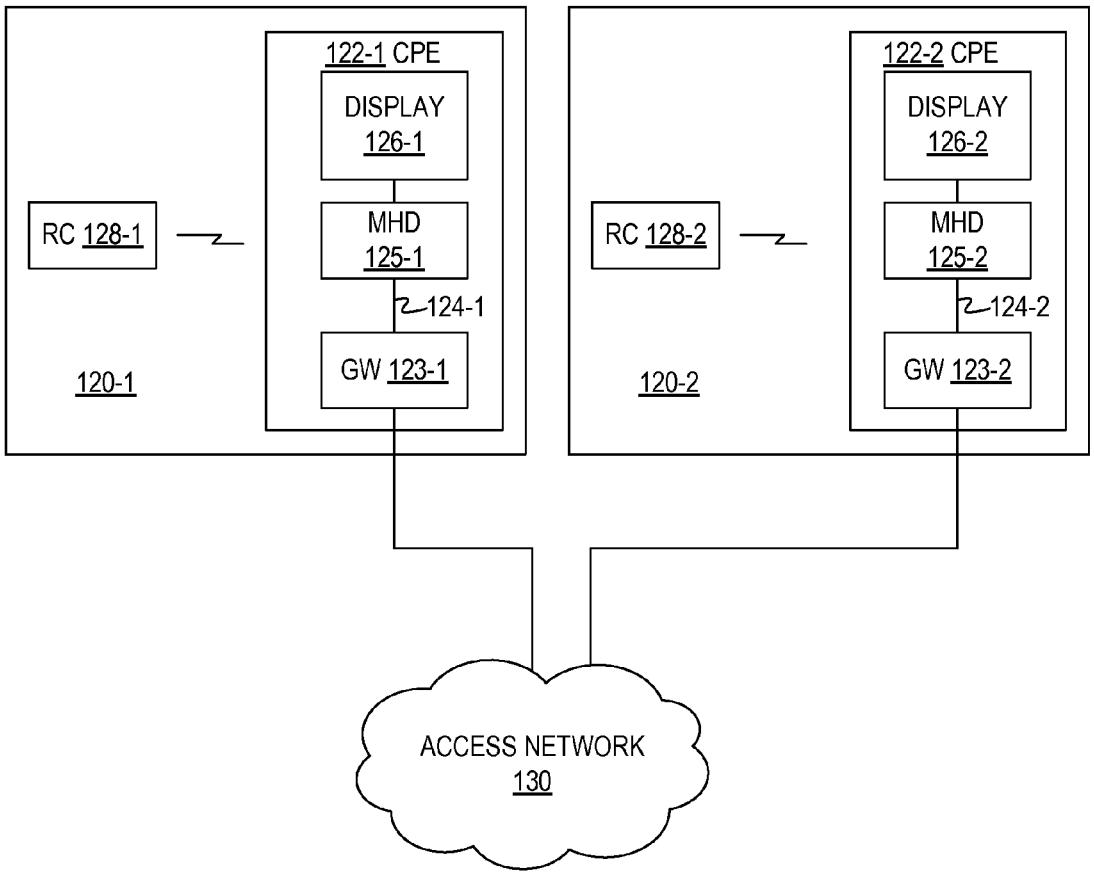
FIG. 2 is a block diagram of selected elements of an embodiment of a multimedia content distribution network.

Turning now to FIG. 2, clients 120 are shown in additional detail with respect to access network 130. Clients 120 may include network appliances collectively referred to herein as CPE 122. In the depicted embodiment, CPE 122 includes the following devices: gateway (GW) 123, multimedia handling device (MHD) 125, and display device 126. Any combination of GW 123, MHD 125, and display device 126 may be integrated into a single physical device. Thus, for example, CPE 122 might include a single physical device that integrates GW 123, MHD 125, and display device 126. As another example, MHD 125 may be integrated into display device 126, while GW 123 is housed within a physically separate device.

In FIG. 2, GW 123 provides connectivity for client 120 to access network 130. GW 123 provides an interface and conversion function between access network 130 and client-side local area network (LAN) 124. GW 123 may include elements of a conventional DSL or cable modem. GW 123, in some embodiments, may further include routing functionality for routing multimedia content, conventional data content, or a combination of both in compliance with IP or another network layer protocol. In some embodiments, LAN 124 may encompass or represent an IEEE 802.3 (Ethernet) LAN, an IEEE 802.11-type (WiFi) LAN, or a combination thereof. GW 123 may still further include WiFi or another type of wireless access point to extend LAN 124 to wireless-capable devices in proximity to GW 123. GW 123 may also provide a firewall (not depicted) between clients 120 and access network 130.

Clients 120 as depicted in FIG. 2 further include a display device or, more simply, a display 126. Display 126 may be implemented as a TV, a liquid crystal display screen, a computer monitor, or the like. Display 126 may comply with a display standard such as National Television System Committee (NTSC), Phase Alternating Line (PAL), or another suitable standard. Display 126 may include one or more integrated speakers to play audio content.

Clients 120 are further shown with their respective remote control 128, which is configured to control the operation of MHD 125 by means of a user interface (not shown in FIG. 2) displayed on display 126. Remote control 128 of client 120 is operable to communicate requests or commands wirelessly to MHD 125 using infrared (IR) or radio frequency (RF) signals. MHDs 125 may also receive requests or commands via buttons (not depicted) located on side panels of MHDs 125.

In some embodiments, remote control 128 may represent a URC device that is configured to control multiple pieces of equipment. When the equipment controlled by the URC device changes, the URC device may be reprogrammed, for example, to add a new device. The URC device may be programmed using a local transceiver (see FIG. 3) coupled to CPE 122. In some cases, CPE 122 may receive network commands to reprogram the URC device, as will be described in detail below.

MHD 125 is enabled and configured to process incoming multimedia signals to produce audio and visual signals suitable for delivery to display 126 and any optional external speakers (not depicted in FIG. 2). Incoming multimedia signals received by MHD 125 may be compressed and/or encrypted, digital or analog, packetized for delivery over packet switched embodiments of access network 130 or modulated for delivery over cable-based access networks. In some embodiments, MHD 125 may be implemented as a stand-alone set top box suitable for use in a co-axial or IP-based multimedia content delivery network.

Figure 3:
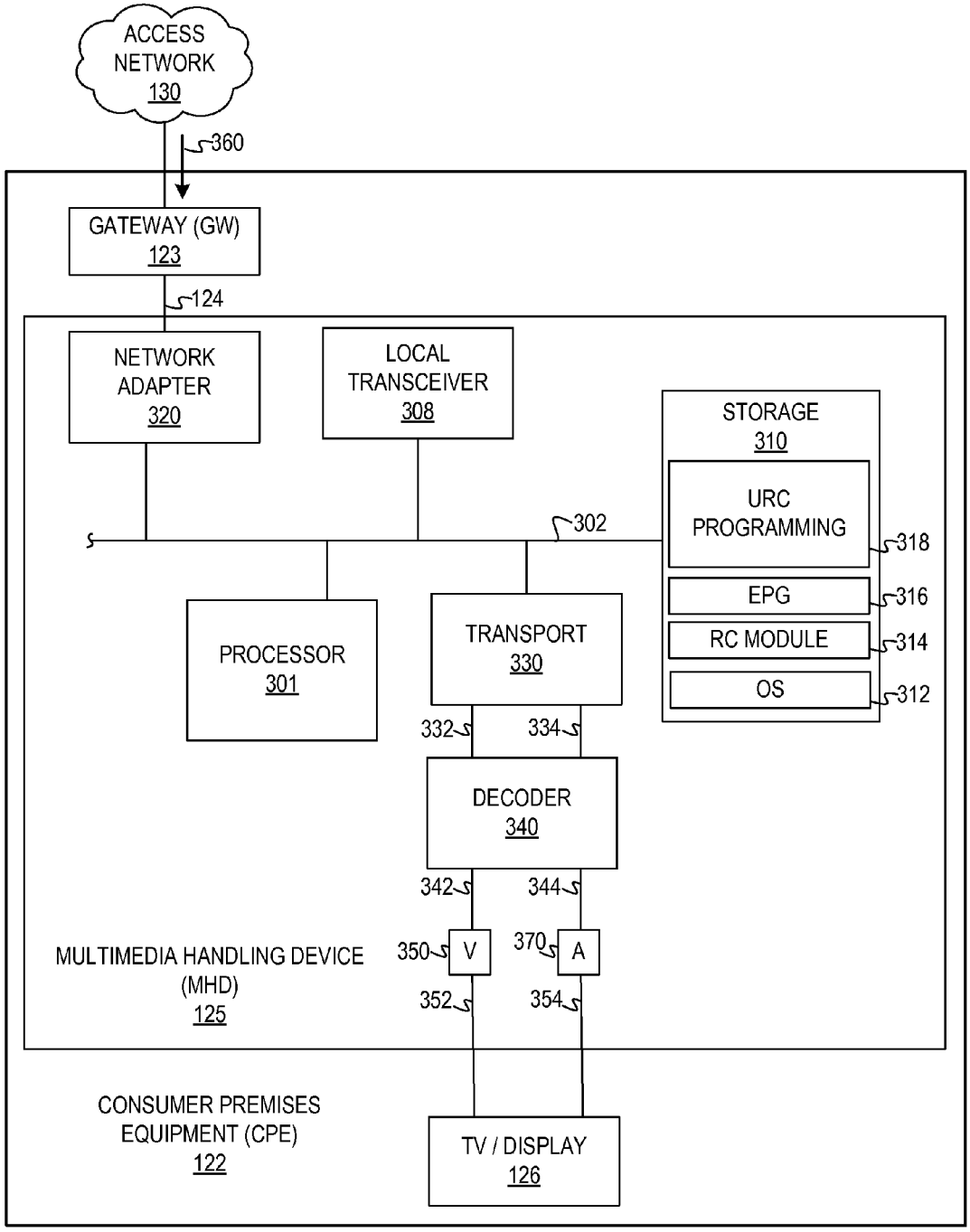
FIG. 3 is a block diagram of selected elements of an embodiment of a multimedia handling device.

Referring now to FIG. 3, a block diagram illustrating selected elements of an embodiment of MHD 125 is presented. In FIG. 3, MHD 125 is shown as a functional component of CPE 122 along with GW 123 and display 126, independent of any physical implementation, as discussed above with respect to FIG. 2. In particular, it is noted that CPE 122 may be any combination of GW 123, MHD 125 and display 126.

In the embodiment depicted in FIG. 3, MHD 125 includes processor 301 coupled via shared bus 302 to storage media collectively identified as storage 310. MHD 125, as depicted in FIG. 3, further includes network adapter 320 that interfaces MHD 125 to LAN 124 and through which MHD 125 receives multimedia content 360. GW 123 is shown providing a bridge between access network 130 and LAN 124, and receiving multimedia content 360 from access network 130.

In embodiments suitable for use in IP based content delivery networks, MHD 125, as depicted in FIG. 3, may include transport unit 330 that assembles the payloads from a sequence or set of network packets into a stream of multimedia content. In coaxial based access networks, content may be delivered as a stream that is not packet based and it may not be necessary in these embodiments to include transport unit 330. In a co-axial implementation, however, clients 120 may require tuning resources (not explicitly depicted in FIG. 3) to "filter" desired content from other content that is delivered over the coaxial medium simultaneously and these tuners may be provided in MHDs 125. The stream of multimedia content received by transport unit 330 may include audio information and video information and transport unit 330 may parse or segregate the two to generate video stream 332 and audio stream 334 as shown.

Video and audio streams 332 and 334, as output from transport unit 330, may include audio or video information that is compressed, encrypted, or both. A decoder unit 340 is shown as receiving video and audio streams 332 and 334 and generating native format video and audio streams 342 and 344. Decoder 340 may employ any of various widely distributed video decoding algorithms including any of the Motion Pictures Expert Group (MPEG) standards, or Windows Media Video (WMV) standards including WMV 9, which has been standardized as Video Codec-1 (VC-1) by the Society of Motion Picture and Television Engineers. Similarly decoder 340 may employ any of various audio decoding algorithms including Dolby® Digital, Digital Theatre System (DTS) Coherent Acoustics, and Windows Media Audio (WMA).

The native format video and audio streams 342 and 344 as shown in FIG. 3 may be processed by encoders/digital-to-analog converters (encoders/DACs) 350 and 370 respectively to produce analog video and audio signals 352 and 354 in a format compliant with display 126, which itself may not be a part of MHD 125. Display 126 may comply with NTSC, PAL or any other suitable television standard.

Storage 310 encompasses persistent and volatile media, fixed and removable media, and magnetic and semiconductor media. Storage 310 is operable to store instructions, data, or both. Storage 310 as shown may include sets or sequences of instructions, namely, an operating system 312, a remote control application program identified as RC module 314, an EPG 316, and URC programming 318. Operating system 312 may be a UNIX or UNIX-like operating system, a Windows® family operating system, or another suitable operating system. In some embodiments, storage 310 is configured to store and execute instructions provided as services to client 120 by application server 150, as mentioned previously.

EPG 316 represents a guide to the multimedia content provided to client 120 via MCDN 100, and may be shown to the user as an element of the user interface. The user interface may include a plurality of menu items arranged according to one or more menu layouts, which enable a user to operate MHD 125. The user may operate the user interface, including EPG 316, using remote control 128 (see FIG. 2) in conjunction with RC module 314. In some embodiments, URC application 152 (see FIG. 1), in conjunction URC programming 318, provides functionality to reprogram or reconfigure a URC device, as will now be described in further detail below.

Local transceiver 308 represents an interface of MHD 125 for communicating with external devices, such as remote control 128, or another URC device. Local transceiver 308 may provide a mechanical interface for coupling to an external device, such as a plug, socket, or other proximal adapter. In some cases, local transceiver 308 is a wireless transceiver, configured to send and receive IR or RF or other signals. A URC device configured to operate with CPE 122 may be reconfigured or reprogrammed using local transceiver 308. In some embodiments, local transceiver 308 is also used to receive commands for controlling equipment from the URC device. Local transceiver 308 may be accessed by RC module 314 for providing remote control functionality.

Figure 4:
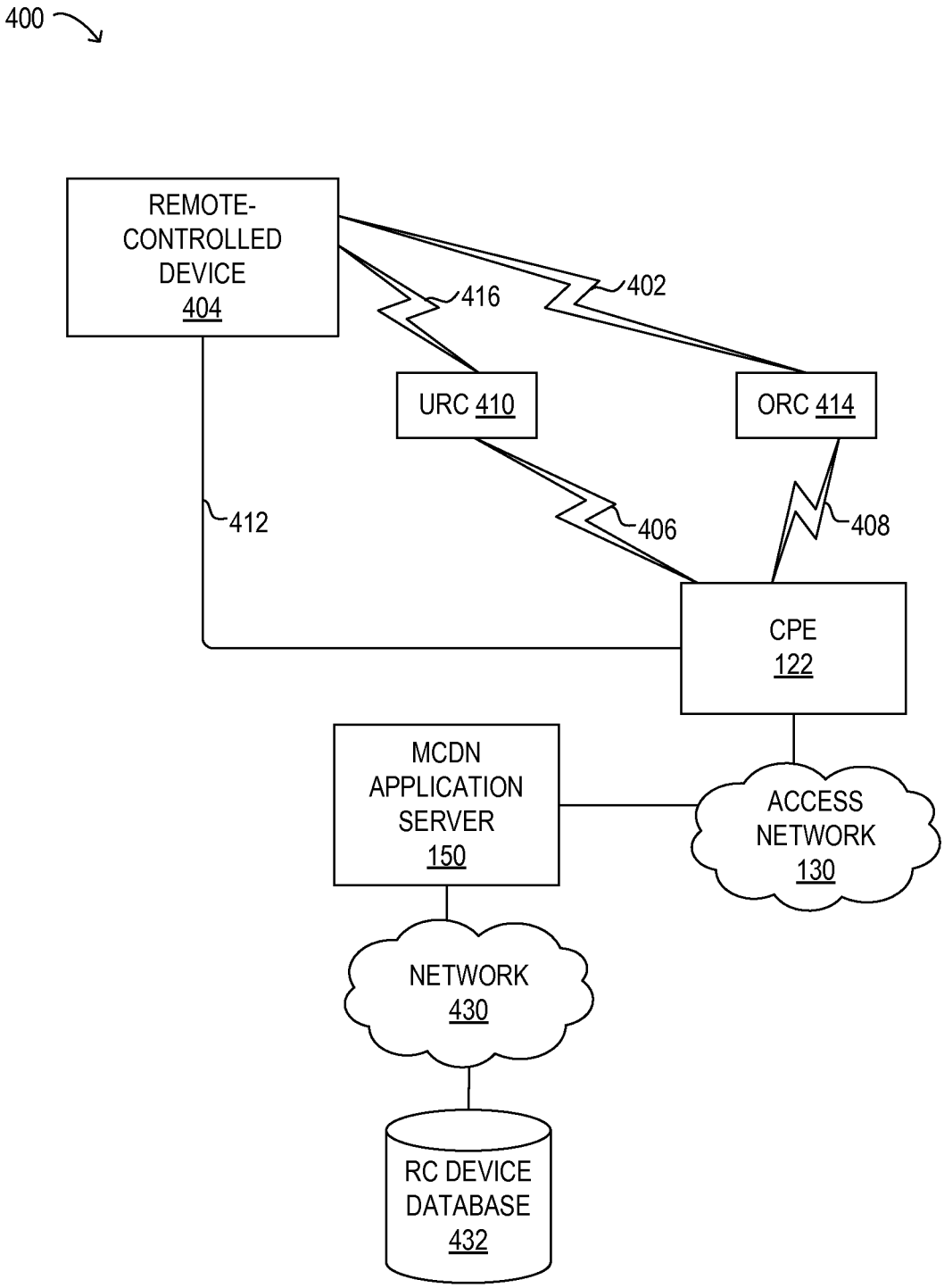
FIG. 4 a block diagram of selected elements of an embodiment of a universal remote control system.

Turning now to FIG. 4, a block diagram of selected elements of an embodiment of URC system 400 are depicted. In URC system 400, ORC 414, URC 410, and CPE 122 may be in proximity to remote-controlled device 404, for example at a location of an MCDN client 120. URC system 400 illustrates devices, interfaces and information that may be processed to program URC 410 to control remote-controlled device 404. The reconfiguring, or reprogramming, of URC 410 may be complex, error prone, or time-consuming for a user. URC system 400 is a platform that may allow a user to reprogram URC 410 using services provided by MCDN 100. It is noted that in FIG. 4, communication links 402, 406, 408, and 416 may be wireless or mechanically connected interfaces. It is further noted that like numbered elements in FIG. 4 represent components discussed above with respect to FIGS. 1-3.

In FIG. 4, remote-controlled device 404 may refer to a piece of equipment that is introduced for use with or near CPE 122. In some embodiments, remote-controlled device 404 may be controllable by remote control, and may be suitable for control by URC 410. Remote-controlled device 404 may also represent an existing instrument or device that is in use, but not yet controllable using URC 410, because URC 410 may not yet be configured to control remote-controlled device 404. Remote-controlled device 404 may further include one or more local transceivers or interfaces (not explicitly shown in FIG. 4) for communicating with remote controls, or for control by another piece of equipment, as will be described below.

ORC 414 may be a remote control that is dedicated for operation with remote-controlled device 404, for example, via communication link 402. That is, ORC 414 may represent original equipment provided with remote-controlled device 404, such that remote-controlled device 404 and ORC 414 may communicate via communication link 402 as a stand-alone unit. ORC 414 may be configured to use codes, or coded instructions, that are specific to remote-controlled device 404. ORC 414 may further be specific to a device-type (i.e., model, configuration, etc.) corresponding to remote-controlled device 404, such that ORC 414 may be operable with any manufactured instance of a particular device model, represented by remote-controlled device 404.

In some cases remote-controlled device 404 may be coupled to CPE 122. The coupling to CPE 122 may be subordinate in nature, such that remote-controlled device 404 may be controlled by CPE 122 in response to commands or signals received by local transceiver 308 (see FIG. 3). In URC system 400, CPE 122 is shown with exemplary coupling 412 to remote-controlled device 404. It is noted that coupling 412 is optional and may be omitted in certain embodiments.

In FIG. 4, URC 410 may communicate with CPE 122 via communication link 406. Communication link 406 may be used to receive remote-control commands (i.e., in the form of codes or instructions) from URC 410. Alternatively, communication link 406 may be used to reprogram (i.e., reconfigure) URC 410 to send different commands or to control different equipment. For example, communication link 406 may be used to reconfigure URC 410 to use programming codes corresponding to remote-controlled device 404. In some instances, communication link 406 may be used to limit or delete existing functionality, for which URC 410 may be configured.

As shown in FIG. 4, ORC 414 may communicate with CPE 122 via communication link 408. Communication link 408 may be used by CPE 122 to receive programming codes from ORC 414 that are specific to remote-controlled device 404. As will be described in detail below, CPE 122 may prompt a user to activate a control element of ORC 414 while operating ORC 414 with CPE 122. CPE 122 may perform communications via communication link 408 using local transceiver 308 (see FIG. 3) to identify remote-controlled device 404.

In FIG. 4, after URC 410 has been configured with at least some programming codes corresponding to remote-controlled device 404, URC 410 may communicate via communication link 416 with remote-controlled device 404. That is, URC 410 may emulate at least some functionality using communication link 416 that ORC 414 is capable of using communication link 402. From the perspective of remote-controlled device 404, communication links 402 and 416 may appear identical or indistinguishable. In other words, remote-controlled device 404 may not be aware that URC 410 is emulating ORC 414, and may respond to communication links 402 or 416 in an identical manner.

It is particularly noted that in FIG. 4, two distinct pathways for URC 410 controlling remote-controlled device 404 are depicted in URC system 400. A first pathway is communication link 416, which represents direct control of remote-controlled device 404 by URC 410, without intervention from CPE 122. A second pathway is shown via CPE 122, using communication link 406 and coupling 412, as described above. In this configuration, URC 410 may directly communicate with CPE 122 via communication link 406, for example, using local interface 308 (see FIG. 3). CPE 122 may then relay or forward an instruction received by URC 410 to remote-controlled device 404 using coupling 412. It is noted that in the second pathway, the actual commands transmitted using communication link 406 and/or coupling 412 may be different from each other, and may further be different from actual commands transmitted by communication links 402 or 416. In other words, coupling 412 may represent an interface with its own command set, that is different from the actual command set used by ORC 414 via communication link 402. Further, using the second pathway, CPE 122 may configure URC 410 to transmit a different code using communication link 406 for a given command to control remote-controlled device 404 than what would be expected using communication link 402.

In FIG. 4, CPE 122 may communicate with MCDN application server 150 via access network 130. Access network 130 may represent a "last-mile" access network providing service to a large number of MCDN client systems (see FIGS. 1-3). MCDN application server 150 may, in turn, communicate with external systems using network 430, for example, with RC device database 432. As illustrated in FIG. 4, MCDN application server 150 may retrieve RC device information from RC device database 432 over network 430. Network 430 may be a public or private network, while RC device database 432 may be operated by an external business entity. RC device database 432 may include device information for a variety of different RC devices, which may be controllable by URC 410. The RC device information may include programming codes for specific RC devices. Thus, MCDN application server may 150 may query RC device database 432, in one embodiment, using a model identifier to retrieve programming codes for remote-controlled device 404. It is noted that in different embodiments (not shown in FIG. 4) RC device database 432 may be included as an internal component of MCDN application server 150, and may be accessed directly using network 430 or another network In operation of URC system 400, as shown in FIG. 4, a user (not shown) may initiate a URC configuration request to CPE 122 for configuring URC 410 to control remote-controlled device 404. The user may provide a device attribute of remote-controlled device 404 along with the URC configuration request. CPE 122 may then obtain at least one control element of ORC 414 from MCDN application server 150 in response to providing the device attribute. The user may then be prompted by CPE 122 to activate the control element of ORC 414 with CPE 122, that is, using communication link 408. This action may provide CPE 122 with a code that can be used to identify remote-controlled device 404. CPE 122 may use the code to query MCDN application server 150 for at least one identity of remote-controlled device 404. In certain embodiments, CPE 122 may repeat the user prompt to obtain a first code and a second code. The first code and the second code may be used by CPE 122 to query the MCDN application server 150 to uniquely identify remote-controlled device 404, or to further limit the possible identities of remote-controlled device 404. This process may be repeated for a third and fourth prompt, etc., as desired.

CPE 122 may then display, or otherwise send, at least one potential identity for remote-controlled device 404 to the user. The user may then acknowledge and/or confirm the identity. Next, CPE 122 may now use the identity to query MCDN application server 150 for programming codes for remote-controlled device 404. In some instances, MCDN application server 150 may, in turn, obtain the programming codes from RC device database 432, which may be provided by a third-party. After obtaining or retrieving the desired programming codes, MCDN application server 150, executing URC application 152 (see FIG. 1), may send the programming codes back to CPE 122. CPE 122 may prompt the user to place URC 410 in a location accessible by communication link 406. CPE 122 may then program URC 410 with at least some of the programming codes. CPE 122 may display an indication of being ready to reprogram URC 410 and/or an indication that communication link 406 to URC 410 has been established. In some cases, CPE 122 may wait for user input before proceeding to configure URC 410. Finally, CPE 122 may send or display an acknowledgement to the user that URC 410 has been successfully configured for use with remote-controlled device 404 using communication link 416.

In certain embodiments, CPE 122 may query MCDN application server 150 for programming codes for remote-controlled device 404 that are specific to coupling 412. CPE 122 may then configure URC 410 with programming codes corresponding to at least some of the programming codes for remote-controlled device 404 using coupling link 412.

After URC 410 has been programmed, or reprogrammed, CPE 122 may receive a confirmation via communication link 406, and may display an indication that URC 410 has been successfully configured to control remote-controlled device 404. In some cases, CPE 122 may transmit the confirmation/indication of successful URC configuration to MCDN application server 150, which may, in turn, send a confirmation to another device, such as a user mobile communications device, originating the URC configuration request.

After being successfully configured, URC 410 may control remote-controlled device 404. In one embodiment, URC 410 may use communication link 416 to directly control remote-controlled device 404. In other embodiments, URC 410 may control remote-controlled device 404 by communicating with CPE 122 via communication link 406, and in turn, via coupling 412.

Figure 5:
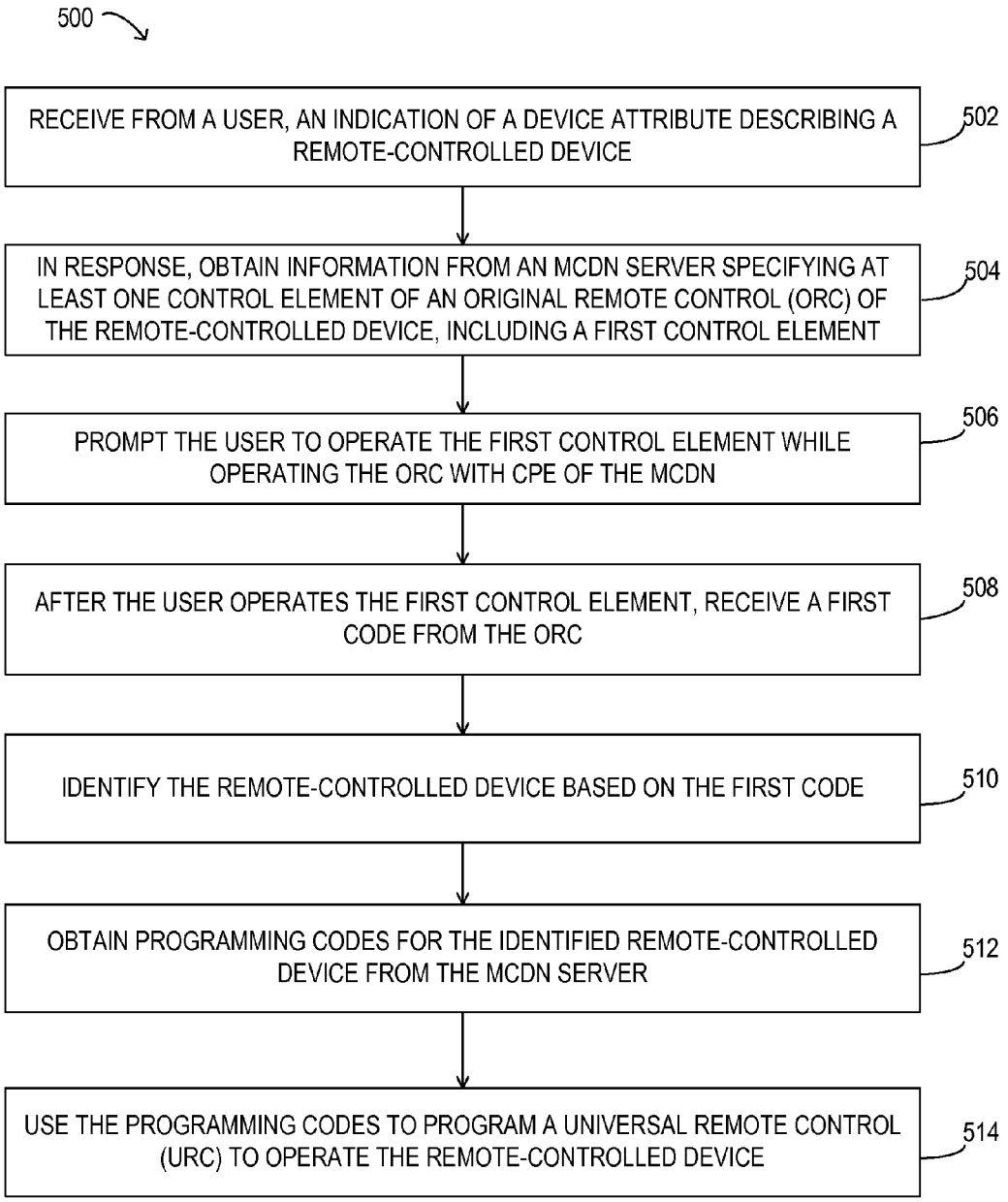
FIG. 5 illustrates an embodiment of a method for programming a universal remote control.

Turning now to FIG. 5, an embodiment of method 500 for programming a universal remote control is illustrated. In one embodiment, method 500 is performed by URC programming 318 executing on MHD 125 of CPE 122. Method 500 may also be performed in conjunction with functionality provided by URC application 152 executing on application server 150. It is noted that certain operations described in method 500 may be optional or may be rearranged in different embodiments. In method 500, it is assumed that remote-controlled device 404 has been introduced alongside CPE 122 of MCDN client 120, and that URC 410 is capable of controlling remote-controlled device 404 (see FIG. 4).

An indication of a device attribute describing a remote-controlled device may be received from a user (operation 502). The indication may be included in a request to reprogram a URC, such as URC 410, to operate with the remote-controlled device, such as remote-controlled device 404 (see FIG. 4). In response, information from an MCDN server, specifying at least one control element of an ORC of the remote-controlled device, including a first control element, may be obtained (operation 504). In some instances, multiple control elements, which may be successively used to identify remote-controlled device 404, of the ORC, such as ORC 414, may be specified in information received from the MCDN server, such as MCDN application server 150 (see FIG. 1, 4). The user may then be prompted to operate the first control element while operating the ORC with CPE of the MCDN (operation 506). After the user operates the first control element, a first code may be received from the ORC (operation 508). The user may be given feedback from the CPE indicating when the CPE is in communication with the ORC, and further indicating that a code corresponding to the first control element has been received. Based on the first code, the remote-controlled device may be identified (operation 510). Operations to identify the remote-controlled device may include obtaining additional codes, in addition to the first code (see FIG. 6). The remote-controlled device may be uniquely identified based on one or more codes, including the first code.

Next, programming codes for the identified remote-controlled device may be obtained from the MCDN server (operation 512). Programming codes, usable to program the URC, may be obtained in response to sending a request to the MCDN server. The request may include an identity of the remote-controlled device. The identity may be given by a model number, a device number, a part number, a serial number, a model name or description, other device information, or a combination thereof. The programming codes may be received from the MCDN server via an access network. The programming codes may then be used to program a URC to operate the remote control device (operation 514). At least some of the programming codes received from the MCDN server may be used to program the URC. In some embodiments, the URC is programmed with codes corresponding to respective programming codes for the remote-controlled device, such that the URC can generate commands associated with the programming codes.

Figure 6:
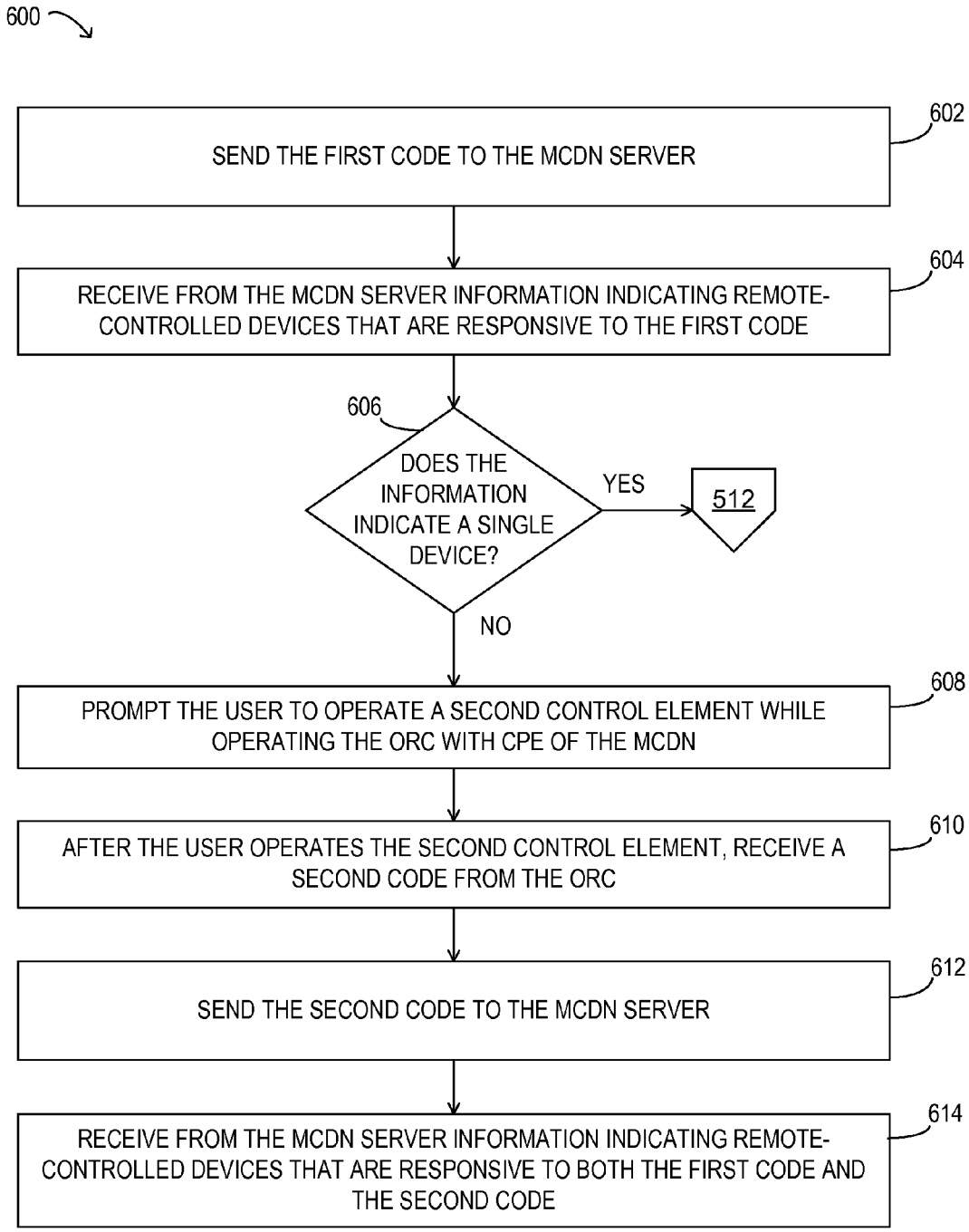
FIG. 6 illustrates an embodiment of a method for programming a universal remote control.

Turning now to FIG. 6, an embodiment of method 600 for programming a universal remote control is illustrated. Method 600 may represent an embodiment of operation 510 in method 500, in which the remote-controlled device may be identified based on the first code (see FIG. 5).

The first code may be sent to the MCDN server (operation 602). The first code may be sent along with a request to identify the remote-controlled device. Information indicating remote-controlled devices that are responsive to the first code may be received from the MCDN server (operation 604). It is noted that devices responsive to the first code may include devices that are also responsive to additional codes. The information indicating which remote-controlled devices are responsive may therefore include at least one remote-controlled device. A decision may then be made, if the information indicates a single remote-controlled device (operation 606). If the result of operation 606 is YES, then method 600 may terminate and proceed with operation 512 in method 500 (see FIG. 5). If the result of operation 606 is NO, then the information has indicated more than one remote-controlled device, and method 600 may proceed to prompt the user to operate a second control element while operating the ORC with CPE of the MCDN (operation 608).

After the user operates the second control element, a second code from the ORC may be received (operation 610). The second code may then be sent to the MCDN server (operation 612). Information indicating remote-controlled devices that are responsive to both the first code and the second code may be received from the MCDN server (operation 614). It is noted that identifying remote-controlled devices responsive to both the first code and the second code is included in identifying remote-controlled devices responsive to the first code. In certain cases, the information received in operation 614 may indicate a single or a small number of remote-controlled device(s). It is noted that method 600 may be repeated with successive control elements, as desired, until the remote-controlled device has been sufficiently narrowed down to a single device, or a small number of devices.

Figure 7:
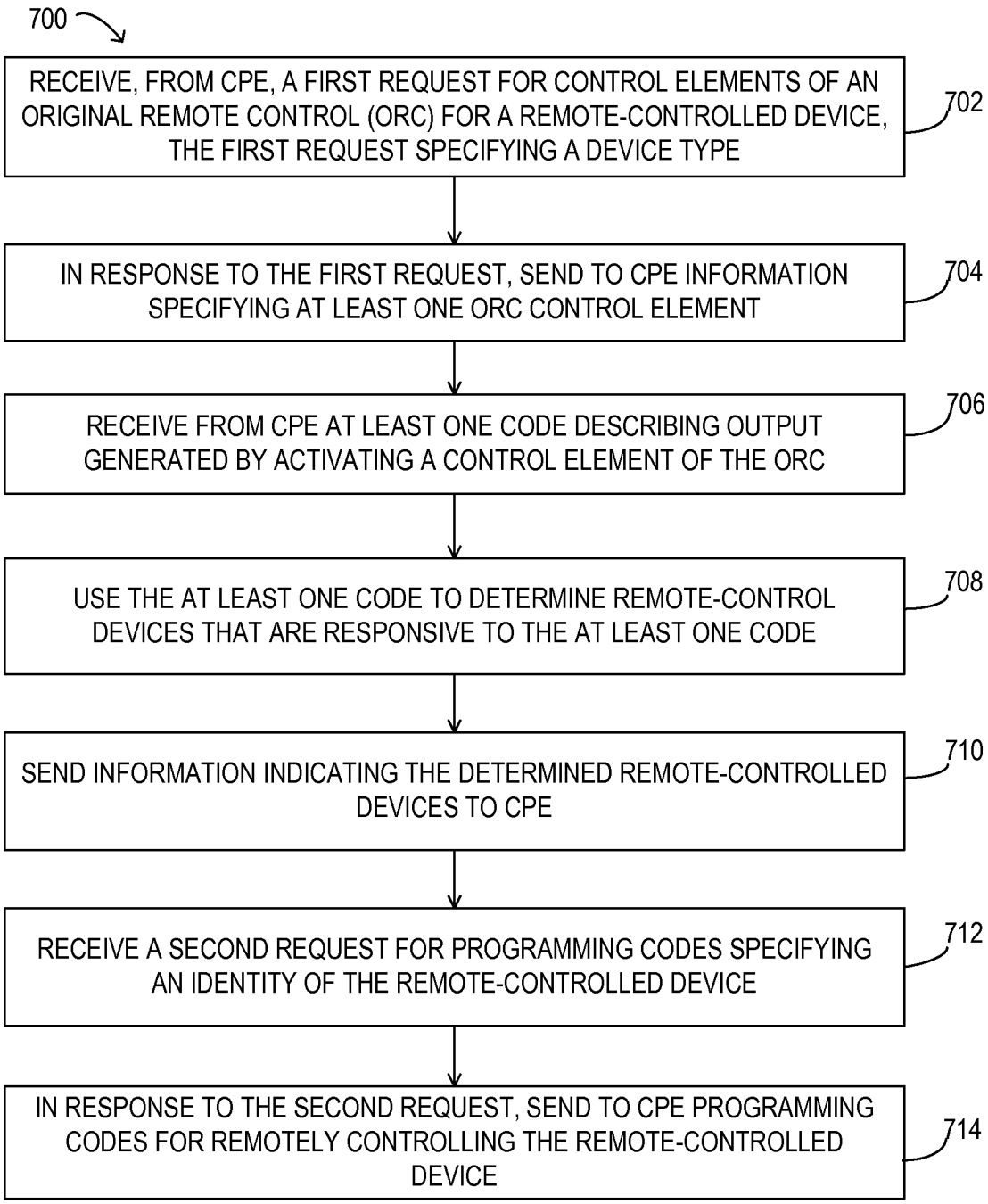
FIG. 7 illustrates an embodiment of a method for programming a universal remote control.

Turning now to FIG. 7, an embodiment of method 700 for programming a URC is illustrated. In one embodiment, method 700 is performed by URC application 152 executing on application server 150. Method 700 may also be performed in conjunction with functionality provided by a client device on the MCDN, such as URC programming 318 executing on MHD 125 of CPE 122. It is noted that certain operations described in method 700 may be optional or may be rearranged in different embodiments. In method 700, it is assumed that a remote-controlled device 404 has been introduced alongside CPE 122 of MCDN client 120, and that URC 410 is capable of controlling remote-controlled device 404 (see FIG. 4).

A first request for control elements of an ORC for a remote-controlled device, the first request specifying a device type, may be received from CPE (operation 702). In response to the first request, information specifying at least one ORC control element may be sent to CPE (operation 704). At least one code describing output generated by activating a control element of the ORC may be received from CPE (operation 706). The at least one code may be used to determine remote-controlled device(s) that are responsive to the at least one code (operation 708). Information indicating the determined remote-controlled device(s) may be sent to CPE (operation 710). A second request for programming codes, specifying an identity of the remote-controlled device may be received (operation 712). In response to the second request, programming codes for remotely controlling the remote-controlled device may be sent to CPE (operation 714).

To the maximum extent allowed by law, the scope of the present disclosure is to be determined by the broadest permissible interpretation of the following claims and their equivalents, and shall not be restricted or limited to the specific embodiments described in the foregoing detailed description.

What is claimed is:

1. A remote control method, comprising:

receiving, by a multimedia handling device including a network adapter to receive multimedia content from a multimedia content distribution network server and a decoder to process multimedia content for display on a display, a request from a user to reprogram a universal remote control, wherein the request includes a device type of the remote-controlled device;

prompting the user to activate a first control element of an original remote control associated with the remote-controlled device;

receiving, by the multimedia handling device, a first code transmitted by the original remote control in response to activation of the first control element;

attempting to identify the remote-controlled device based on the first code;

responsive to identifying multiple remote-controlled devices based on the first code, repeatedly prompting the user to activate additional control elements and attempting to identify the remote-controlled device based on all codes received until the remote controlled device is identified; and responsive to identifying the remote-controlled device based on the first code:

retrieving programming codes for the remote-controlled device; and programming, by the multimedia handling device, the universal remote control to associate a code selected from the programming codes with a control element of the universal remote control, wherein the universal remote control transmits the code to the remote-controlled device in response to activation of the control element.

2. The method of claim 1, wherein attempting to identify the remote-controlled device includes:

sending the first code to a multimedia content distribution network server; and receiving, from the multimedia content distribution network server, information indicating identified remote-controlled devices that are responsive to the first code.

3. The method of claim 2, wherein the remote-controlled device is uniquely identified using the information received from the multimedia content distribution network.

4. The method of claim 2, wherein repeatedly prompting the user and attempting to identify the remote-controlled device includes:

prompting the user to operate a second control element of the original remote control;

receiving a second code from the original remote control;

sending the second code to the multimedia content distribution network server; and receiving, from the multimedia content distribution network server, information indicating identified remote-controlled devices that are responsive to both the first code and the second code.

5. The method of claim 1, wherein retrieving the programming codes for the remote-controlled device includes:

retrieving the programming codes from the multimedia content distribution network server.

6. The method of claim 1, further comprising:

sending an identity of the remote-controlled device to the user; and receiving a confirmation from the user acknowledging the identity.

7. The method of claim 1, further comprising:

displaying a confirmation indicating that the universal remote control has been successfully configured with a code selected from the programming codes.

8. The method of claim 1, wherein prompting the user includes sending an instruction to operate the original remote control with consumer-premises equipment associated with the multimedia content distribution network.

9. The method of claim 1, wherein a command is associated with a code selected from the programming codes.

10. The method of claim 1, wherein the programming of the universal remote control includes programming the universal remote control via a wireless communication link.

11. A multimedia handling device for use within a client configuration of a multimedia content distribution network, the multimedia handling device comprising:

a processor;

a local transceiver;

a network adapter to receive multimedia content from a network server;

a decoder to process the multimedia content received via the network;

a computer readable medium, accessible to a processor, including instructions, executable by the processor that, when executed by the processor, cause the processor to perform operations comprising:

receiving, by the multimedia handling device including a network adapter to receive multimedia content from a multimedia content distribution network server and a decoder to process multimedia content for display on a display, a request from a user to reprogram a universal remote control, wherein the request includes a device type of a remote-controlled device;

prompting the user to activate a first control element of an original remote control associated with the remote-controlled device;

receiving, by the multimedia handling device, a first code transmitted by the original remote control in response to activation of the first control element;

attempting to identify the remote-controlled device based on the first code;

responsive to identifying multiple remote-controlled devices based on the first code, repeatedly prompting the user to activate additional control elements and attempting to identify the remote-controlled device based on all codes received until the remote-controlled device is identified; and responsive to identifying the remote-controlled device based on the first code:

retrieving programming codes for the remote-controlled device; and programming, by the multimedia handling device, the universal remote control to associate a code selected from the programming codes with a control element of the universal remote control, wherein the universal remote control transmits the code to the remote-controlled device in response to activation of the control element.

12. The multimedia handling device of claim 11, wherein the operations include:

in response to sending the device type to the multimedia content distribution network server, obtain information from the multimedia content distribution network server specifying a control element of the original remote control, including the first control element.

13. The multimedia handling device of claim 11, wherein the operations include:

prompting the user to operate a second control element of the original remote control;

after the user operates the second control element, receiving a second code from the original remote control at the local transceiver; and in response to sending a request including the first code and the second code to a multimedia content distribution network server, retrieving programming codes for the remote-controlled device.

14. The multimedia handling device of claim 13, wherein prompting the user to operate the second control element occurs responsive to receiving an indication of more than one remote-controlled device that corresponds to the first code.

15. The multimedia handling device of claim 11, wherein the operations include:

receiving, at the local transceiver from the universal remote control, a command to control the remote-controlled device; and instructing the remote-controlled device to execute the command.

16. The multimedia handling device of claim 15, wherein the command is associated with at least one of the programming codes.

17. The multimedia handling device of claim 11, wherein prompting the user includes prompting the user to operate the original remote control with the local transceiver.

18. A computer-readable memory device, including program instructions, executable by a processor that, when executed by the processor, cause the processor to perform operations comprising:

receiving, by a multimedia handling device including a network adapter to receive multimedia content from a multimedia content distribution network server and a decoder to process multimedia content for display on a display, a request from a user to reprogram a universal remote control, wherein the request includes a device type of the remote-controlled device;

prompting the user to activate a first control element of an original remote control associated with the remote-controlled device;

receiving, by the multimedia handling device, a first code transmitted by the original remote control in response to activation of the first control element;

attempting to identify the remote-controlled device based on the first code;

responsive to identifying multiple remote-controlled devices based on the first code, repeatedly prompting the user to activate additional control elements and attempting to identify the remote-controlled device based on all codes received until the remote-controlled device is identified; and responsive to identifying the remote-controlled device based on the first code:

retrieving programming codes for the remote-controlled device; and programming, by the multimedia handling device, the universal remote control to associate a code selected from the programming codes with a control element of the universal remote control, wherein the universal remote control transmits the code to the remote-controlled device in response to activation of the control element.

19. The memory device of claim 18, wherein the operations include operations for:

configuring the universal remote control to operate the remote-controlled device by programming the universal remote control to use a code selected from the programming codes.

20. The memory device of claim 19, wherein the operations include operations for:

receiving, from the universal remote control, a command to control the remote-controlled device; and instructing the remote-controlled device to execute the command;

wherein the command is associated with at least one of the programming codes.

21. The memory device of claim 18, wherein the operations for identifying the remote-controlled device using the first code further include operations for:

sending a request to the multimedia content distribution network server to identify the remote-controlled device, the request including the first code; and in response to sending the request, receiving an identity of the remote-controlled device.

22. The memory device of claim 18, wherein the operations for identifying the remote-controlled device using the first code further include operations for:

prompting the user to operate a second control element by using the original remote control with consumer premises equipment of the multimedia content distribution network;

in response to the user operating the second control element, receiving a second code from the original remote control;

sending a request to the multimedia content distribution network server to identify the remote-controlled device, the request including the first code and the second code; and in response to sending the request, receiving an identity of the remote-controlled device.

* * * * *